United States Patent [19]

Cummings

[11] 3,976,162

[45] Aug. 24, 1976

[54] PERSONAL SPEAKER SYSTEM

[75] Inventor: Kenneth R. Cummings, Newburgh, N.Y.

[73] Assignee: Lawrence Peska Associates, Inc., New York, N.Y. ; a part interest

[22] Filed: Apr. 7, 1975

[21] Appl. No.: 565,855

[52] U.S. Cl. ..... 181/141; 181/144; 181/148; 179/146 H

[51] Int. Cl.[2] ..... G10K 10/00

[58] Field of Search ..... 181/126, 141, 143, 144, 181/145, 148, 155, 147; 179/146 H, 149, 156, 157; 297/391, 397–402

[56] References Cited

UNITED STATES PATENTS

| | | | |
|---|---|---|---|
| 1,552,593 | 9/1925 | Childress | 179/156 |
| 2,464,435 | 3/1949 | Conradt | 179/156 X |
| 2,527,656 | 10/1950 | Reinsdorf | 179/146 H |
| 2,629,023 | 2/1953 | La Fitte | 179/146 H |
| 3,098,128 | 7/1963 | Audin | 179/146 H |
| 3,230,320 | 1/1966 | Kerr | 179/146 H |
| 3,272,926 | 9/1966 | Falkenberg | 179/156 R X |

*Primary Examiner*—John Gonzales

[57] ABSTRACT

An elongated arm having cooperating sections as provided which may be selectively positioned with respect to each other to vary the effective length of the arm. Carried at each end of the arm for pivotal motion is an individual speaker. The assembly is normally carried at the top of the backrest of a chair or car seat position with speakers disposed proximate the ears of a single listener.

1 Claim, 5 Drawing Figures

FIG. 1
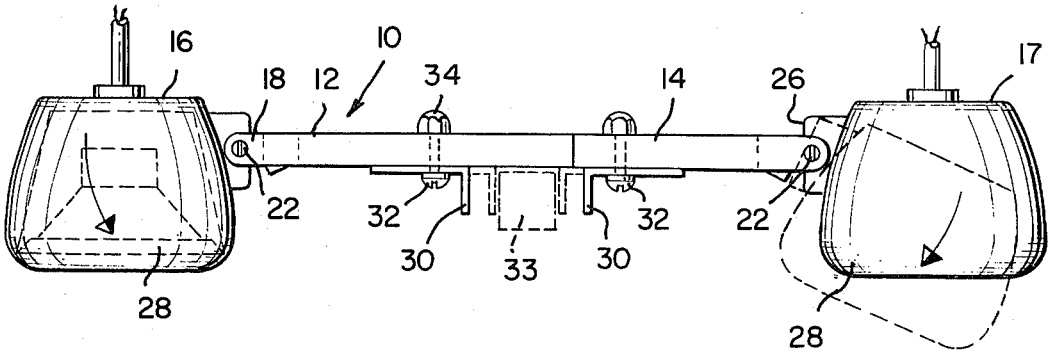
FIG. 2
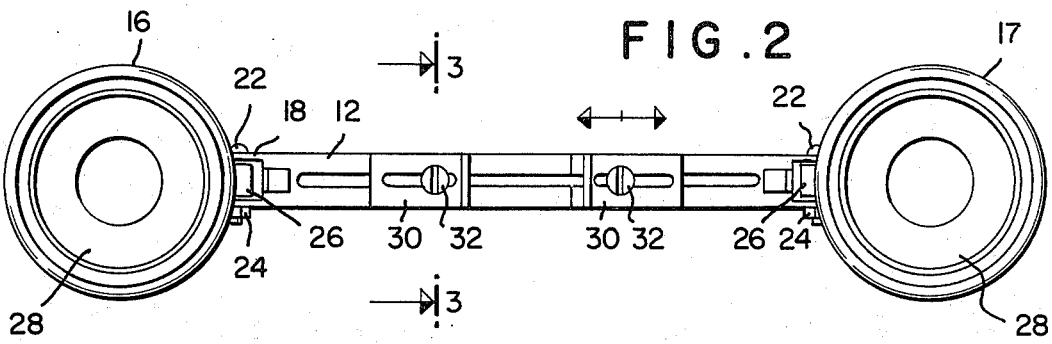
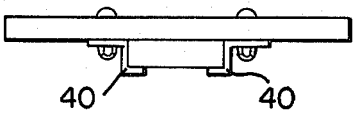
FIG. 4
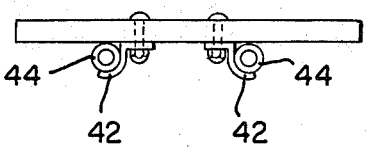
FIG. 5
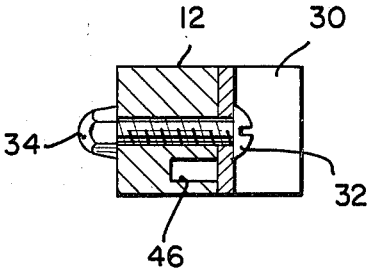
FIG. 3

PERSONAL SPEAKER SYSTEM

BACKGROUND OF THE INVENTION

The invention relates to sound reproduction systems and particularly to speaker systems intended for use by a single person. These include the apparatus shown in the following U.S. Pat. Nos.: Lanzara, 3,384,719; McCorkle, 3,512,605; Carsello, et al, 3,452,836; Kerr, 3,230,320; and Audin 3,098,128. The apparatus as shown therein in general has not been particularly suited for automobiles and did not provide sufficient adjustability to satisfactorily position the speakers for optimum listening conditions.

It is a primary object of the invention to provide apparatus which includes at least two speakers and which will facilitate the positioning of the speakers for an individual listener in a manner which optimizes listening conditions.

It is another object of the invention to provide apparatus which is particularly suited for use in an automobile.

Yet another object of the invention is to provide apparatus which is simple and inexpensive to manufacture.

SUMMARY OF THE INVENTION

It has now been found that these and other objects of the invention may be attained by an arm having elongated cooperating sections for selectively varying the length of the arm. Disposed at the ends of the arm are speakers mounted for pivotal motion with respect to the arm. A bracket may be disposed in one form of the invention on the arm for engagement with the support for the headrest of an automobile.

BRIEF DESCRIPTION OF THE DRAWING

The invention will be better understood by reference to the accompanying drawing in which:

FIG. 1 is a plan view of the apparatus in accordance with the invention;

FIG. 2 is a side elevational view of the apparatus shown in FIG. 1;

FIG. 3 is a sectional view taken through the line 3—3 of FIG. 2;

FIG. 4 is a central fragmentary plan view of another form of the invention; and FIG. 5 is a central fragmentary plan view of still another form of the invention similar to that shown in FIG. 4.

DESCRIPTION OF THE PREFERRED EMBODIMENT

Referring now to FIGS. 1 through 4 there is shown one form of the invention which comprises an elongated bar 10 which comprises two separate elongated sections 12, 14. In the form shown the sections 12, 14 are nesting channels. In other forms of the invention the elongated sections 12, 14 may be telescopically arranged to provide the necessary adjustment in length of the arm 10. Disposed at each end of the arm 10 are speaker enclosures 16, 17 which in the preferred form are pivotally mounted by means of yokes 18, disposed on the ends of the arm 10 and which cooperate with bolts 22 and nuts 24 as well as lugs 26 carried on the speaker enclosure 16, 17. Disposed within the enclosures are speakers 28. In one form of the invention, the speakers 28 are 3 inch 4 or 8 ohm speakers. Brackets 30 are provided for engagement with a headrest support 33 which is part of an associated automobile. The brackets 30 are carried by means of machine screws 32 and nuts 34. It will be seen that movement of brackets 30 may be accomplished as indicated by the dotted lines in FIG. 1 to permit firm clamping against the sides of the support 33.

In other forms of the invention brackets 40 as shown in FIG. 4 may be utilized to engage another style of headrest support. Similarly the brackets 42 shown in FIG. 5 may be utilized for gripping still another style of headrest support which utilizes two upstanding tubular members 44.

It will be understood that the invention has application not only to automobiles where it is particularly desirable to grip the headrest support to position the speaker assembly near the ears of the listener but also has application for use with arm chairs and other locations. It will be understood that the elongated member 12 is provided with a channel 46 for accommodation of wiring extending to the speakers. In some forms of the invention a ball swivel joint may be used as opposed to a pivoting axis as shown in FIGS. 1 and 2. The apparatus in accordance with the invention avoids a problem common to most automobile stereo systems. More particularly the problem is that the stereo sound is in general not balanced for more than one person in the motor vehicle. Utilization of a speaker assembly in accordance with the invention for each person in the car overcomes this problem and allows each passenger and driver to receive balanced stereo sound. In addition the overall volume from all speakers operating within the vehicle may be reduced due to the closeness of the speakers to any individual passenger who is listening.

Having thus described my invention, I claim:

1. A speaker system comprising: an elongated arm being selectively variable in length, bracket means carried by said arm configured for locking engagement with the generally vertical headrest support post means of an associated automobile; said bracket means being configured for securing said arm to said post means with opposite ends of said arm extending from said post means; and first and second speakers respectively pivotly carried by said opposite ends of said arm.

* * * * *